US008124246B2

(12) United States Patent
Tolpygo

(10) Patent No.: US 8,124,246 B2
(45) Date of Patent: Feb. 28, 2012

(54) COATED COMPONENTS AND METHODS OF FABRICATING COATED COMPONENTS AND COATED TURBINE DISKS

(75) Inventor: Vladimir K. Tolpygo, Scottsdale, AZ (US)

(73) Assignee: Honeywell International Inc., Morristown, NJ (US)

( * ) Notice: Subject to any disclaimer, the term of this patent is extended or adjusted under 35 U.S.C. 154(b) by 30 days.

(21) Appl. No.: 12/273,843

(22) Filed: Nov. 19, 2008

(65) Prior Publication Data

US 2010/0124670 A1 May 20, 2010

(51) Int. Cl.
*B32B 15/04* (2006.01)

(52) U.S. Cl. ..... 428/610; 428/678; 416/241 R

(58) Field of Classification Search ..... None
See application file for complete search history.

(56) References Cited

U.S. PATENT DOCUMENTS

| | | | | |
|---|---|---|---|---|
| 4,070,507 | A | 1/1978 | Stueber et al. | |
| 4,526,814 | A | 7/1985 | Shankar et al. | |
| 4,962,005 | A * | 10/1990 | Alperine et al. | 428/670 |
| 5,607,564 | A | 3/1997 | Stormbom | |
| 5,667,663 | A | 9/1997 | Rickerby et al. | |
| 5,824,205 | A | 10/1998 | Foster | |
| 5,837,385 | A | 11/1998 | Schaeffer et al. | |
| 5,843,588 | A | 12/1998 | Rose et al. | |
| 6,080,246 | A | 6/2000 | Wing | |
| 6,106,685 | A | 8/2000 | McBride et al. | |
| 6,183,888 | B1 | 2/2001 | Alperine et al. | |
| 6,444,332 | B1 | 9/2002 | Bettridge | |
| 6,537,388 | B1 * | 3/2003 | Wynns et al. | 148/279 |
| 7,229,701 | B2 | 6/2007 | Madhava et al. | |
| 7,645,485 | B2 * | 1/2010 | Madhava | 427/252 |
| 2005/0145503 | A1 | 7/2005 | Kozlov et al. | |
| 2006/0141283 | A1 | 6/2006 | Madhava | |

* cited by examiner

*Primary Examiner* — Aaron Austin
(74) *Attorney, Agent, or Firm* — Ingrassia, Fisher & Lorenz, P.C.

(57) ABSTRACT

Coated components and methods of fabricating coated components and coated turbine disks are provided. In an embodiment, by way of example only, a coated component includes a substrate comprising a superalloy in an unmodified form and a coating disposed over the substrate, where the coating comprises the superalloy in a modified form. The modified form of the superalloy includes, by weight, at least 10% more chromium and at least 10% more of one or more noble metals than the unmodified form of the superalloy, and the modified form of the superalloy is substantially free of aluminum.

10 Claims, 3 Drawing Sheets

COATED COMPONENTS AND METHODS OF FABRICATING COATED COMPONENTS AND COATED TURBINE DISKS

TECHNICAL FIELD

The inventive subject matter generally relates to turbine engine components, and more particularly relates to coatings for turbine disks and methods of fabricating coated turbine disks.

BACKGROUND

Turbine engines are used as the primary power source for various kinds of aircraft. The engines may also serve as auxiliary power sources that drive air compressors, hydraulic pumps, and industrial electrical power generators. Most turbine engines generally follow the same basic power generation procedure. Compressed air is mixed with fuel and burned, and the expanding hot combustion gases are directed against stationary turbine vanes in the engine. The vanes turn the high velocity gas flow partially sideways to impinge onto turbine blades mounted on a rotatable turbine disk. The force of the impinging gas causes the turbine disk to spin at high speed. Jet propulsion engines use the power created by the rotating turbine disk to draw more air into the engine, and the high velocity combustion gas is passed out of the gas turbine aft end to create forward thrust.

Turbine engines typically operate more efficiently with increasingly hotter operating temperatures. Accordingly, to maximize the engine efficiency, attempts have been made to form turbine engine components having higher operating temperature capabilities. For example, turbine disks are typically made of nickel-based superalloys or cobalt-based superalloys, which exhibit strength and creep resistance at relatively high temperatures (e.g., 704° C. (1300° F.)), as well as resistance to fatigue crack initiation. However, as turbine disks are increasingly being exposed to operating temperatures above 704° C. (1300° F.), the aforementioned superalloys from which they are fabricated may not be adequately corrosion-resistant in such environments. In particular, the superalloys may be susceptible to salt attacks, which may decrease the useful life of the turbine disk.

Hence, there is a need for materials and components that may be more corrosion-resistant when exposed to engine operating temperatures that exceed 704° C. (1300° F.). In addition it is desirable for materials to be relatively inexpensive to implement into turbine engine component manufacturing processes. Moreover, it is desirable for the manufacturing process to be relatively simple to perform.

BRIEF SUMMARY

Coated components and methods of fabricating coated components and coated turbine disks are provided.

In an embodiment, by way of example only, a coated component includes a substrate comprising a superalloy in an unmodified form and a coating disposed over the substrate, where the coating comprises the superalloy in a modified form. The modified form of the superalloy includes, by weight, at least 10% more chromium and at least 10% more of one or more noble metals than the unmodified form of the superalloy, and the modified form of the superalloy is substantially free of aluminum.

In another embodiment, by way of example only, a method of fabricating a coated component includes chromizing a substrate comprising a superalloy to form a chromium-enriched exterior portion of the substrate and diffusing a noble metal into the chromium-enriched exterior portion of the substrate to form the coated component.

In still another embodiment, by way of example only, a method of fabricating a coated turbine disk includes chromizing a substrate comprising a superalloy to form a chromium-enriched exterior portion of the substrate, cleaning a surface of the chromium-enriched exterior portion of the substrate, electroplating a noble metal to the surface of the chromium-enriched exterior portion of the substrate to form an electroplated substrate, and heat treating the electroplated substrate to diffuse the noble metal therein to form the coated turbine disk.

BRIEF DESCRIPTION OF THE DRAWINGS

The inventive subject matter will hereinafter be described in conjunction with the following drawing figures, wherein like numerals denote like elements.

DETAILED DESCRIPTION

The following detailed description is merely exemplary in nature and is not intended to limit the inventive subject matter or the application and uses of the inventive subject matter. In particular, although the inventive subject matter is described as being applied to a turbine disk, it will be appreciated that the inventive subject matter may be incorporated onto any other components that may be exposed to temperatures and gases that may exceed 704° C. (1300° F.). Furthermore, there is no intention to be bound by any theory presented in the preceding background or the following detailed description.

Figure 1:
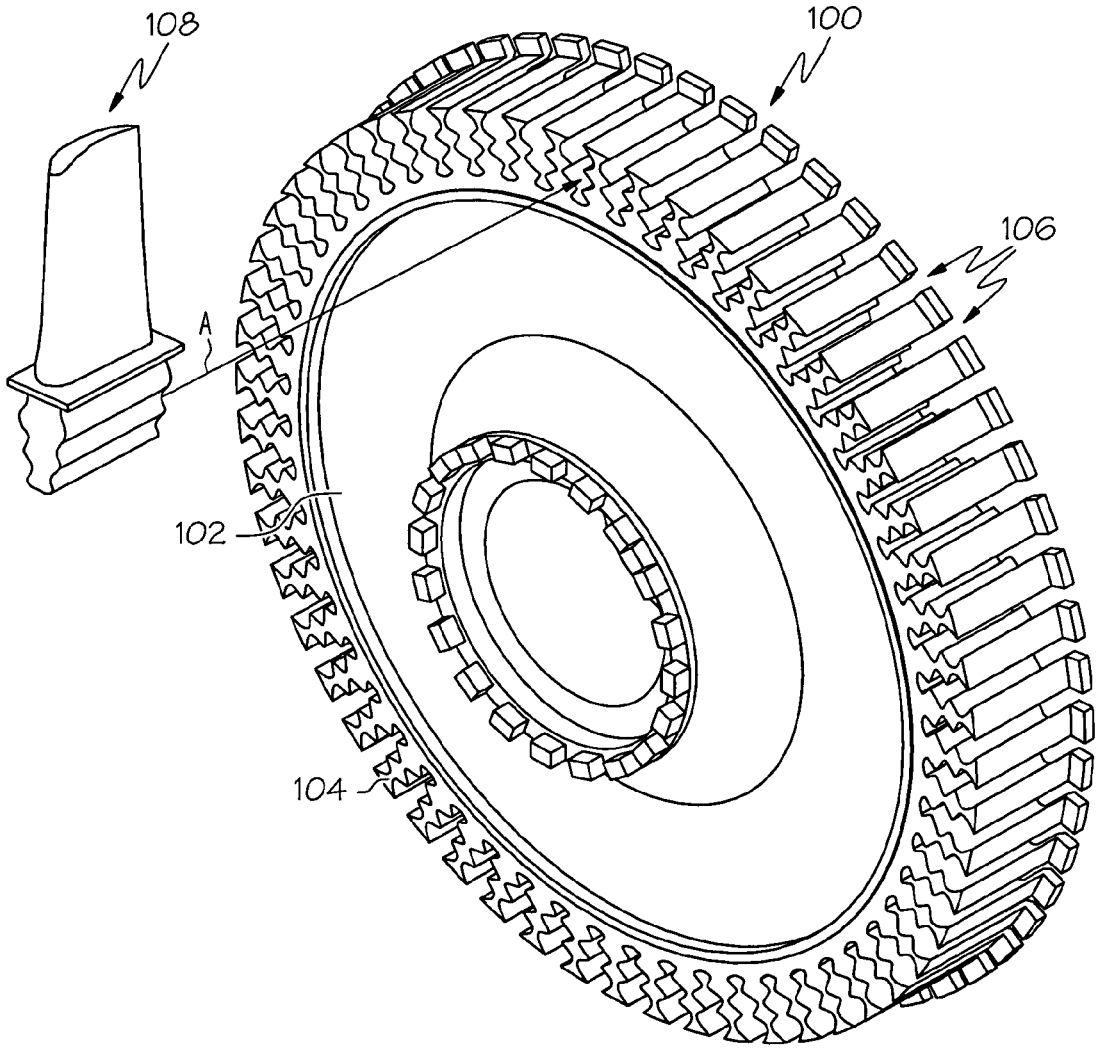
FIG. 1 is a perspective view of a coated turbine engine component, according to an embodiment.

FIG. 1 is a perspective view of a turbine engine component 100, according to an embodiment. In an embodiment, such as shown in FIG. 1, the turbine engine component 100 may be a turbine disk. However, in other embodiments, the turbine engine component 100 may be any other component that may be exposed to temperatures or gases that exceed 704° C. (1300° F.). In an embodiment, the turbine engine component 100 includes a disk 102 that has an outer rim 104 within which a plurality of blade attachment slots 106 is circumferentially formed. Although fifty-six blade attachment slots 106 are shown, more or fewer slots may be included in other embodiments. Each blade attachment slot 106 may be configured to attach a turbine blade 108 to the turbine disk, as indicated by arrow A.

Figure 2:
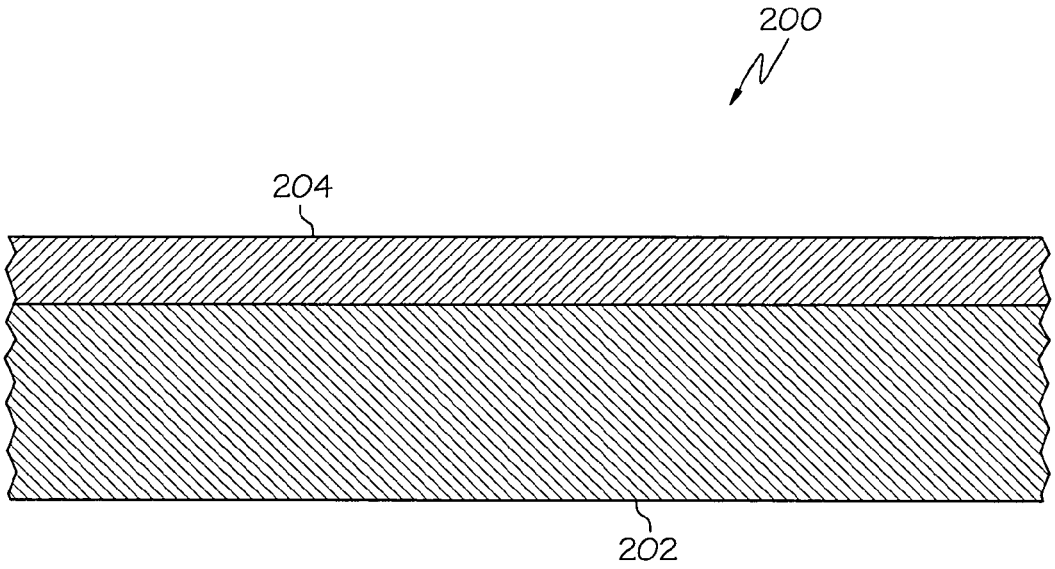
FIG. 2 is a sectional view of a portion of the coated turbine engine component of FIG. 1, according to an embodiment.

Turning to FIG. 2, a sectional view of a portion of a turbine engine component 200 is provided, according to an embodiment. In an embodiment, the turbine engine component 200 includes a substrate 202 and a coating 204. The substrate 202 may comprise an unmodified form of a superalloy that may be conventionally used in fabricating turbine engine components. For example, the superalloy may be, for example, a nickel-based superalloy or a cobalt-based superalloy. Suitable nickel-based superalloys include, but are not limited to IN100, IN718, and Rene 104.

The coating 204 is disposed over the substrate 202 and is formulated to prevent corrosion of the turbine engine component 200 when exposed to temperatures or gases of at least 704° C. (1300° F.), in an embodiment. In this regard, the coating 204 comprises a modified form of the superalloy from which the interior portion 202 is fabricated, where the modified form of the superalloy is enriched with chromium and a noble metal, but is substantially free (e.g., includes less than about 3% by weight) of aluminum. In particular, increasing an amount of chromium and noble metal in the coating 204 provides increased resistance to corrosion in environments in which molten salts (e.g., mixtures of $Na_2SO_4$+10% NaCl) may be present. Additionally, by decreasing and/or omitting aluminum entirely from the coating 204, the coating 204 may be more ductile than other protective coatings that include aluminum, such as nickel-aluminide or platinum-aluminide coatings. Moreover, because chromium is more soluble in superalloys than in aluminide coatings, omitting aluminum may allow the coating 204 to contain more chromium and to have improved adhesion to the substrate 202. In another embodiment, to further avoid brittleness and improve ductility, the coating 204 may also be substantially free of silicon.

In one embodiment, the modified form of the superalloy includes between about 20% by weight and about 40% by weight of chromium, which is substantially higher than in the unmodified form of the superalloy, which typically includes between 10% by weight and 15% by weight of chromium. In another embodiment, the modified form of the superalloy may additionally include between about 10% by weight and about 30% by weight of a noble metal. The noble metal may comprise platinum, palladium, iridium, or a combination thereof. In accordance with one embodiment of the modified form of the superalloy, chromium is included in a range of from about 20% to about 40% by weight, platinum is included in a range of about 10% to about 30% by weight, and a balance of nickel and/or cobalt is included. Several alloying additions, specifically molybdenum, tungsten, tantalum, and niobium may be present in the coating 204 in a combined amount of from about 0.5% by weight to about 5% by weight, as these elements may diffuse from the superalloy comprising the substrate 202 into an outer layer of the coating 204 during fabrication. In an embodiment, the cumulative amount of aluminum and titanium, which also may diffuse into the coating 204 from the substrate 202, does not exceed about 5% by weight.

The coating 204 may have a thickness in a range of from about 25 microns to about 50 microns. In another embodiment, the thickness of the coating 204 may greater or less than the aforementioned range. Though depicted in FIG. 2 as including a sharp delineation between the coating 204 and the substrate 202, a distinct boundary between the coating 204 and the substrate 202 may not present in most embodiments. In one embodiment, the coating 204 may be graded and a concentration of chromium and/or noble metal at a first location adjacent to the interior portion of the coating 204 may be less than a concentration of chromium and/or noble metal at a second location near an outer surface of the coating 204. For example, the concentration at the first location may be about 20%, while the concentration at the second location may be about 30%. In this way, the coating 204 has improved adhesion to the substrate 202 as compared to other substrate coatings.

Figure 3:
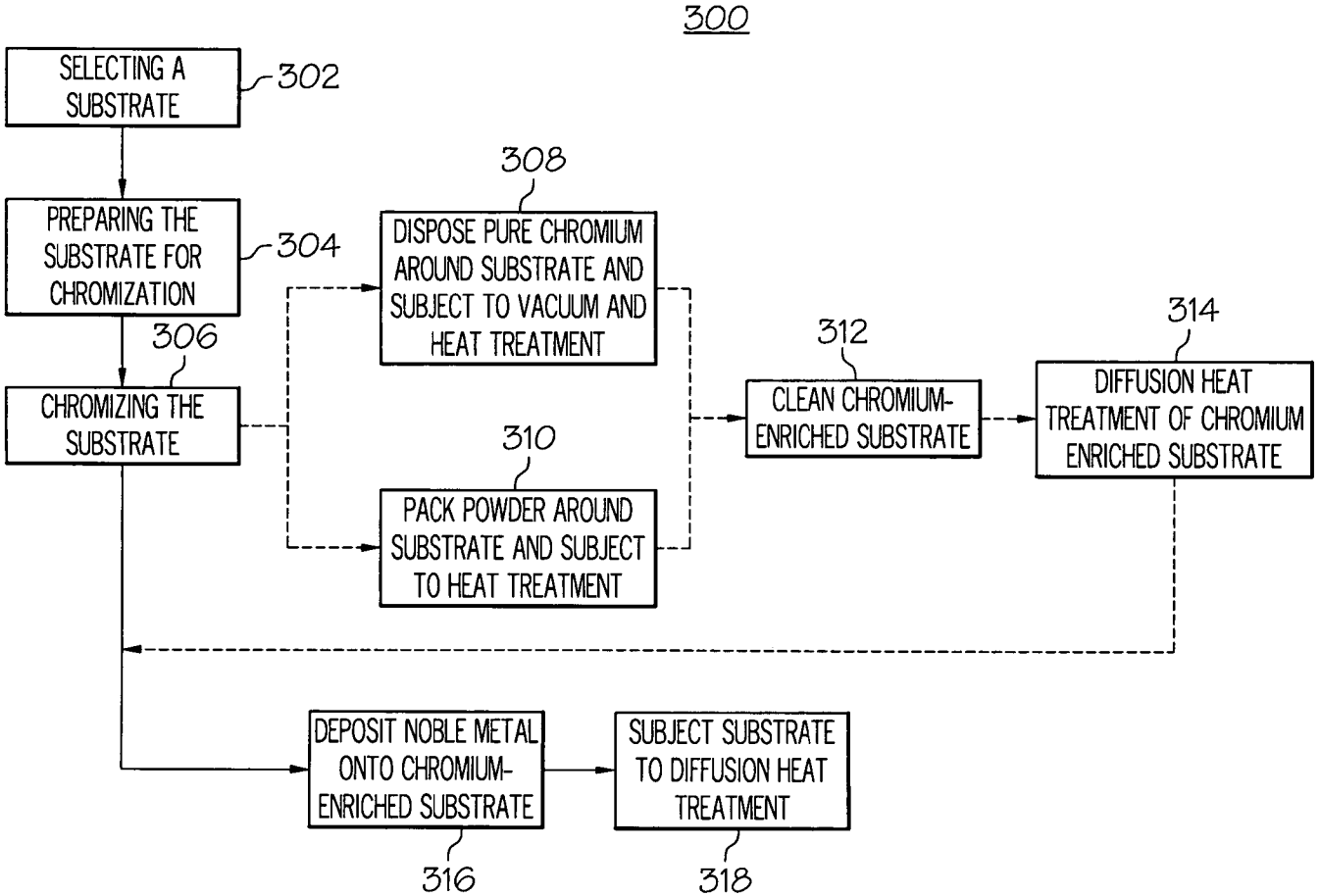
FIG. 3 is a flow diagram of a method of fabricating a coated component, according to an embodiment.

FIG. 3 is a flow diagram of a method 300 of fabricating a coated turbine engine component (e.g., coated turbine engine component 100 of FIG. 1 or coated turbine engine component 200 of FIG. 2), according to an embodiment. In an embodiment, the method 300 includes selecting a substrate for chromization, step 302. According to one embodiment, the substrate may comprise substantially entirely of a superalloy. In accordance with an embodiment, the superalloy from which the substrate comprises may be selected from any one of the unmodified forms of the superalloys mentioned above relating to substrate 202 of FIG. 2. In another embodiment, the substrate may be an off-the-shelf turbine engine component, such as a turbine disk. In still another embodiment, the substrate may be an uncoated superalloy piece that is subsequently machined into a desired shape.

The substrate is then prepared for chromization, step 304. In an embodiment, the substrate may be prepared by chemically preparing a surface thereof that is intended to be coated. For example, in an embodiment in which the substrate includes an outer layer, such as an oxidation film, the outer layer may be removed. Thus, a chemical stripping solution may be applied to the surface of the substrate. Suitable chemicals used to strip the outer layer may include, for example, a mixture of nitric and hydrochloric acids, potassium and/or sodium hydroxides at elevated temperatures. However, other chemicals may alternatively be used, depending on a particular composition of the outer layer. In another embodiment, the substrate may be mechanically prepared. Examples of mechanical preparation include, for example, pre-repair machining and/or degreasing surfaces in proximity to and/or defining the surface to be coated in order to remove any oxidation, dirt or other contaminants. In other embodiments, surface preparation may include grit-blasting the surface to be coated, followed by rinsing with deionized water.

Next, the substrate is subjected to chromizing to form a chromium-rich exterior portion, step 306. In accordance with an embodiment, chromizing may include a vacuum process. In such an embodiment, an initial step of disposing pure chromium (e.g., chromium having a purity of at least 99%) in the form of chunks, slugs or lumps around the substrate may be performed. According to an embodiment, the pure chromium and substrate are placed into a container that is capable of withstanding exposure to temperatures that may be employed during vacuum process. For example, the container may be made of a nickel alloy. The particular dimensions of the container, such as the length, width, and depth of the container, and the particular material from which the container is made may depend on the size and material of the substrate and the type of pure chromium that may be employed in the vacuum process.

In any case, in an embodiment, the pure chromium may be obtained as pieces having diameters in a range of from about 0.1 cm to about 1 cm. The pure chromium pieces may be placed around the substrate, such that substantially an entirety (i.e., up to 100%) of the substrate is surrounded by the pure chromium pieces. In other embodiments, the pure chromium pieces may be larger or smaller than the aforementioned range. In other embodiments, some portions of the substrate surface not requiring a protective coating may not be surrounded by the chromium pieces.

After the pure chromium is disposed around the substrate, the pure chromium and the substrate are subjected to a vacuum environment and heat treatment, step 308. In an embodiment, the container within which the pure chromium and the substrate are disposed is configured to be sealed. Thus, in an embodiment, a vacuum may be drawn on the container and the container and its contents are heated. In another embodiment, the container including the pure chromium and substrate is placed within a vacuum furnace, a vacuum is drawn on the furnace, and a heat treatment is applied.

The heat treatment may include exposing the pure chromium and the substrate to a temperature in a range of from about 1050° C. to about 1150° C. for a time period in a range of from about 1 hour to about 10 hours. In another embodiment, the heat treatment temperature and time period may be greater or less than the aforementioned ranges. In yet another embodiment, the heat treatment may occur as a cycle, and the pure chromium and the substrate may be exposed to more than one temperature, where each exposure may be for a particular amount of time. In any case, the heat treatment ranges and cycles described above are employed to form an exterior portion of the substrate in which the superalloy thereof includes between, by weight, about 10% to about 30% more chromium than the unmodified superalloy of an interior portion of the substrate. In an embodiment, the chromium-enriched exterior portion of the substrate may have a thickness in a range of about 10 microns to about 50 microns. However, it will be appreciated that the thickness of the chromium-enriched exterior portion may be thicker or thinner in other embodiments. In such cases, a longer heat treatment may be employed in order to form the thicker chromium-enriched exterior portion of the substrate, while a shorter heat treatment may be employed to form the thinner chromium-enriched exterior portion. After heat treatment, the substrate is then removed from the container.

In another embodiment of step 306, chromizing includes a pack cementation process in which a powder including chromium is employed and the substrate is heat treated, step 310. For example, the powder may include particles having average particle diameters in a range of between about 100 microns to about 1000 microns. In one embodiment, the powder may include pure chromium. In another embodiment, the powder may include a chromium-cobalt master alloy. For instance, the mixture may include chromium and cobalt at a ratio in a range of 1:1 to 5:1. In another embodiment, the powder may include a mixture of chromium and aluminum oxide ($Al_2O_3$). For instance, the mixture may include chromium and aluminum oxide at a ratio in a range of 1:3 to 1:1. In any case, according to an embodiment, the powder and substrate are placed into a container that is capable of withstanding exposure to temperatures that may be employed during the pack cementation process. For example, the container may be made of a nickel alloy.

In the embodiment in which the powder includes a mixture of chromium and aluminum oxide ($Al_2O_3$), one or more activators are employed to enhance formation of chromium-containing gas and increase the amount of chromium diffusing into the substrate. For example, the activators may be disposed within the container and pre-mixed with the powder. Suitable activators include, but are not limited to ammonium chloride ($NH_4Cl$), chromium (II) chloride/chromium (III) chloride (e.g., $CrCl_2/CrCl_3$) or other halides.

After the substrate is packed in the powder, the heat treatment is performed. The heat treatment may include exposing the powder and the substrate to a temperature in a range of from about 1050° C. to about 1150° C. for a time period in a range of from about 1 hour to about 10 hours. In another embodiment, the heat treatment temperature and time period may be greater or less than the aforementioned ranges. In yet another embodiment, the heat treatment may occur as a cycle, and the powder and the substrate may be exposed to more than one temperature, where each exposure may be for a particular amount of time. In any case, it will be appreciated that a longer heat treatment may be employed in order to form a thicker chromium-enriched exterior portion of the substrate, while a shorter heat treatment may be employed to form a thinner chromium-enriched exterior portion. Subsequent to the heat treatment, the substrate is then removed from the container.

After the chromium-enriched exterior portion of the substrate is formed, the surface of the substrate is cleaned, step 312. In an embodiment, surface cleaning may include brushing excess powder or other unwanted particles off of the substrate. In another embodiment, surface cleaning may include light grit-blasting the surface of the chromium-enriched exterior portion of the substrate, followed by rinsing with deionized water.

A diffusion heat treatment step may be performed, if a concentration of chromium adjacent to the surface of the chromium-enriched exterior portion of the substrate is greater than desired, step 314. In an embodiment, the substrate is placed in a vacuum furnace or an apparatus including an atmosphere of an inert gas, such as argon. The diffusion heat treatment may include further exposure to temperatures in a range of about 1050° C. to about 1150° C. for about 1 to about 10 hours, while in the vacuum furnace or in the atmosphere of inert gas. If a concentration of chromium adjacent to the surface of the chromium-enriched exterior portion of the substrate is not greater than desired, step 314 may be omitted.

Next, a noble metal is deposited onto the chromium-enriched exterior portion of the substrate to form the coated turbine engine component, step 316. The noble metal may include one or more metals such as platinum, palladium, a combination of both platinum and palladium, or other types of noble metals, for example iridium. In an embodiment in which platinum and palladium are used, the two noble metals may be used as a mixture at a ratio in a range of 2:1 to 1:2. Any existing process for depositing noble metals may be used. For example, the noble metal may be electroplated onto the chromium-enriched exterior portion of the substrate. In such case, an electrolytic solution including the noble metal may be employed, the chromium-enriched exterior portion of the substrate or the entire substrate may be submerged into the electrolytic solution, and a suitable current may be applied through the electrolytic solution to cause the noble metal to plate onto the substrate. In another example, the noble metal may be applied using physical vapor deposition methods, such as sputtering. In any case, the noble metal may be deposited to a thickness in a range of between about 5 microns to about 15 microns. In one embodiment, the thickness of the deposited noble metal is about 10 microns.

The substrate including the noble metal deposited thereon is then subjected to a diffusion heat treatment, step 318. In one embodiment, the substrate including the noble metal deposited thereon (e.g., by electroplating, physical vapor deposition, and the like) is placed in a vacuum furnace and subjected to a vacuum environment and heated. In another embodiment, the substrate including the noble metal deposited thereon is placed in a chamber of a furnace, and the chamber is evacuated and filled with an inert gas, such as argon. A heat treatment then may be performed. Heat treatment may include exposing the substrate including the noble metal deposited thereon to a temperature in a range of from about 1050° C. to about 1150° C. for a time period in a range of from about 2 hours to about 5 hours. In another embodiment, the heat treatment temperature and time period may be greater or less than the aforementioned ranges. In yet another embodiment, the heat treatment may occur as a cycle, and the powder and the substrate may be exposed to more than one temperature, where each exposure may be for a particular amount of time.

By forming a coating on a component, where the coating comprises a superalloy that is enriched with chromium and a noble metal, such as platinum, palladium, or both platinum and palladium, and by omitting aluminum from the coating, improved corrosion-resistance is provided for the component when subjected to temperatures of at least 704° C. (1300° F.). The above-described coatings are relatively inexpensive and simple to form. Additionally, the coatings may be formed over existing components, such as existing turbine disks and other turbine engine components, and to form newly coated turbine disks and/or components that may be retrofitted into existing engines.

While at least one exemplary embodiment has been presented in the foregoing detailed description of the inventive subject matter, it should be appreciated that a vast number of variations exist. It should also be appreciated that the exemplary embodiment or exemplary embodiments are only examples, and are not intended to limit the scope, applicability, or configuration of the inventive subject matter in any way. Rather, the foregoing detailed description will provide those skilled in the art with a convenient road map for implementing an exemplary embodiment of the inventive subject matter. It being understood that various changes may be made in the function and arrangement of elements described in an exemplary embodiment without departing from the scope of the inventive subject matter as set forth in the appended claims.

What is claimed is:

1. A coated component fabricated from a superalloy, the coated component comprising:

an unmodified portion of the superalloy; and a coating disposed over the unmodified portion of the superalloy, the coating comprising the superalloy in a modified form, wherein:

the modified form of the superalloy includes at least 10% more chromium and at least 10% more of one or more noble metals than the unmodified portion of the superalloy;

the modified portion of the superalloy is formed by the initial diffusion of chromium into the superalloy and the subsequent diffusion of the one or more noble metals into the superalloy;

the modified form of the superalloy contains less than about 3% aluminum by weight; and the modified portion of the superalloy comprises the outermost portion of the coated component.

2. The coated component of claim 1, wherein the one or more noble metals is selected from the group consisting of platinum, palladium, iridium and a combination thereof.

3. The coated component of claim 1, wherein the superalloy comprises a nickel-based superalloy.

4. The coated component of claim 1, wherein the superalloy comprises a cobalt-based superalloy.

5. The coated component of claim 1, wherein the modified form of the superalloy includes between about 10% and about 30% more chromium than the unmodified form of the superalloy.

6. The coated component of claim 1, wherein the modified form of the superalloy includes between about 10% and about 30% more of the one or more noble metals than the unmodified form of the superalloy.

7. The coated component of claim 1, wherein the modified form of the superalloy comprises, by weight, chromium in a range of from about 20% to about 40%, platinum in a range of from about 10% to about 30%, cobalt in a range of from 0% to about 10%, a combination of aluminum and titanium in a range of from about 0.5% to about 5%, a combination of molybdenum, tungsten, tantalum, and niobium in a range of from about 4% to about 5%, and a balance of nickel.

8. The coated component of claim 1, wherein a thickness of the modified form of the superalloy is in a range of from about 25 microns to about 50 microns.

9. A bladed turbine disk, comprising:

a turbine disk fabricated from a superalloy into which platinum and at least one noble metal is diffused to produce a modified superalloy coating over an unmodified superalloy substrate, the modified superalloy coating containing at least 10% more chromium and at least 10% more of the at least one noble metal than does the unmodified superalloy substrate, and wherein the modified superalloy coating contains less than about 3% aluminum by weight; and a plurality of turbine blades each mounted to the turbine disk.

10. A bladed turbine disk according to claim 9 wherein the modified superalloy coating is substantially free of silicon.

* * * * *